US008141646B2

(12) United States Patent
Allen et al.

(10) Patent No.: US 8,141,646 B2
(45) Date of Patent: Mar. 27, 2012

(54) DEVICE AND METHOD FOR GAS LOCK DETECTION IN AN ELECTRICAL SUBMERSIBLE PUMP ASSEMBLY

(75) Inventors: Robert D. Allen, Claremore, OK (US); John Michael Leuthen, Claremore, OK (US); Dick L. Knox, Claremore, OK (US); Jerald R. Rider, Tulsa, OK (US); Tom G. Yohanan, Broken Arrow, OK (US); Brown L. Wilson, Tulsa, OK (US); Bryan D. Schulze, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 346 days.

(21) Appl. No.: 12/486,121

(22) Filed: Jun. 17, 2009

(65) Prior Publication Data

US 2009/0250210 A1 Oct. 8, 2009

Related U.S. Application Data

(63) Continuation-in-part of application No. 12/144,092, filed on Jun. 23, 2008, now Pat. No. 7,798,215.

(60) Provisional application No. 60/946,190, filed on Jun. 26, 2007.

(51) Int. Cl.
*E21B 43/00* (2006.01)

(52) U.S. Cl. ..... 166/369; 166/105; 166/250.15

(58) Field of Classification Search ..... 166/369, 166/105, 250.15; 417/443, 444, 554
See application file for complete search history.

(56) References Cited

U.S. PATENT DOCUMENTS 5,015,151 A 5/1991 Snyder, Jr. et al.
5,100,288 A 3/1992 Stanislao
5,845,709 A 12/1998 Mack et al.
(Continued)

FOREIGN PATENT DOCUMENTS

EP 0314249 A2 5/1989

OTHER PUBLICATIONS

David L. Divine, Automatic Pump-Off Control for the Variable Speed Submersible Pump, 55th Annual Fall Technical Conference and Exhibition of the Society of Petroleum Engineers of AIME, Sep. 21-24, 1980. Society of Petroleum Engineers of AIME, Dallas, Texas.
International Search Report and Written Opinion dated Nov. 20, 2008, 7 pages.

*Primary Examiner* — William P Neuder
(74) *Attorney, Agent, or Firm* — Bracewell & Giuliani LLP

(57) ABSTRACT

A device and method can detect, and also break, an occurrence of gas lock in an electrical submersible pump assembly in a well bore based upon surface or downhole data without the need for operator intervention. To detect an occurrence of gas lock, an instantaneous value is monitored using a sensor. Then a controller compares the instantaneous value to a threshold value over a predetermined duration to thereby detect the occurrence of gas lock in the electrical submersible pump assembly. Sensors can include, for example, a differential pressure gauge, a pressure gage located in a pump stage located toward the inlet, a fluid temperature sensor located toward the discharge, a free gas detector located near the pump discharge, an electrical resistivity gage, a flow meter located within surface production tubing, and a vibration sensor attached to a tubing string to measure a vibration signature.

18 Claims, 5 Drawing Sheets

U.S. PATENT DOCUMENTS 6,257,354 B1 7/2001 Schrader et al.
6,587,037 B1 7/2003 Besser et al.
6,587,054 B2 7/2003 Besser et al.
6,684,946 B2 2/2004 Gay et al.
6,798,338 B1 9/2004 Layton
7,798,215 B2 * 9/2010 Leuthen et al. ..... 166/250.15
2006/0235573 A1 10/2006 Guion
2008/0067116 A1 * 3/2008 Anderson et al. ..... 210/100

* cited by examiner

DEVICE AND METHOD FOR GAS LOCK DETECTION IN AN ELECTRICAL SUBMERSIBLE PUMP ASSEMBLY

RELATED APPLICATIONS

This application is a continuation-in-part of co-pending U.S. patent application Ser. No. 12/144,092, by Leuthen et al., titled "Device, Method and Program Product to Automatically Detect and Break Gas Locks in an ESP" filed on Jun. 23, 2008, which claims priority to U.S. Provisional Patent Application No. 60/946,190, by Leuthen et al., titled "Device, Method and Program Product to Automatically Detect and Break Gas Locks in an ESP" filed on Jun. 26, 2007, all of which are each incorporated herein in their entireties.

BACKGROUND

1. Field of Invention

The present invention relates, in general, to improving the production efficiency of subterranean wells and, in particular, to a device and method which automatically detects gas locks in an electrical submersible pump assembly ("ESP").

2. Description of the Prior Art

It is well known that gas lock can occur when an ESP ingests sufficient gas so that the ESP can no longer pump fluid to the surface due to, for example, large gas bubbles in the well fluid. Failure to resolve a gas-locked ESP can result in overheating and premature failure. Conventional practice on an ESP is to set a low threshold on motor current to determine when the pump is in gas lock. When this threshold is crossed, the pump is typically stopped and a restart is not attempted until the fluid column in the production tubing has dissipated through the pump. This wait time represents lost production.

It is also known that there are many methods for determining the proper low current threshold and that an unsatisfactory threshold can result in either damage to the motor or nuisance shut downs.

SUMMARY OF INVENTION

In view of the foregoing, embodiments of the present invention provide a device and method for use with an electrical submersible pump assembly which can, for example, detect and break an occurrence of gas lock without the need for operator intervention.

Embodiments of the present invention can detect an occurrence of gas lock by monitoring via a sensor an instantaneous value of a property of a fluid associated with an electrical submersible pump assembly and comparing the instantaneous value to a threshold value over a predetermined duration by a controller. The sensor can be located downhole or at the surface.

In an example embodiment, the sensor can be a differential pressure gauge for measuring a differential pressure of the fluid in the pump between the pump inlet and pump discharge, e.g., the bottom and top of the pump, to determine a drop in pressure. In another example embodiment, the sensor can be a pressure gage located in a pump stage located toward the inlet, e.g., the bottom stages of the pump, to determine a drop in pressure. In yet another example embodiment, the sensor can be a fluid temperature sensor located toward the discharge, e.g., the top of the pump, to determine an increase in temperature.

In other example embodiments, the sensor can be a free gas detector located within the pump to determine a high level of free gas, or the sensor can be an electrical resistivity gage located within the pump to determine a high level of resistivity. Alternately, the sensor can be a flow meter located within surface production tubing to determine no or little flow.

In another example embodiment, the sensor can be a vibration sensor attached to a tubing string to measure an acceleration of the fluid within the tubing string to determine a vibration signature responsive to the measured acceleration of the fluid. The measured vibration signature can then be compared to one or more predetermined vibration signatures stored in memory and associated with gas lock to thereby indicate gas lock.

Once the occurrence of gas lock is detected, embodiments of the present invention can, for example, break the occurrence of gas lock. The method can include, for example, maintaining a pump operating speed. Maintaining a pump operating speed allows the well fluid to remain above the pump in a static condition and allows the gas bubbles in the fluid to rise above the fluid, facilitating a separation of gas and liquid above the pump. After a waiting period of a predetermined duration, the pump operating speed is reduced to a predetermined value defining a flush value, thereby allowing the well fluid to fall back through the pump, flushing out the trapped gas. After a predetermined flush period, the pump operating speed is restored to the previously maintained speed. The embodiments of the present invention have the ability to flush the pump and return the system back to production without requiring system shutdown. In a preferred embodiment, the waiting period is between about 6 to 7 minutes, the flush period is between about 10 and 15 seconds, and the pump operating speed is reduced during the flush period to between about 20 and 25 Hz.

In addition, embodiments of the present invention provide for an algorithm for optimizing an operating speed of the electrical submersible pump assembly to maximize production without need for operator intervention. The algorithm increases the pump operating speed by a predetermined increment, e.g., 0.1 Hz, up to a preset maximum pump operating speed, e.g., 62 Hz, when the instantaneous value is continually above the threshold value for a predetermined stabilization period, e.g., 15 minutes. The algorithm decreases the pump operating speed by a predetermined increment, e.g., 0.1 Hz, if the instantaneous value is continually below the threshold value for a predetermined initialization period, e.g., 2 minutes.

Embodiments of this invention have significant advantages. Example embodiments provide the ability to reliably detect a gas lock, without operator intervention, based upon surface data and/or downhole data. Also, example embodiments have the ability to break a gas lock once detected, without requiring the system to be shut down, improving efficiency and reliability in the production of subterranean wells.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Embodiments of the present invention can detect an occurrence of gas lock in an electrical submersible pump assembly by monitoring via a sensor an instantaneous value of a property of a fluid associated with an electrical submersible pump assembly and comparing the instantaneous value to a threshold value over a predetermined duration by a controller. Properties of a fluid include conditions, such as, pressure, a differential pressure, temperature, free gas detector, electrical resistivity, and flow. The sensor can be located downhole or at the surface. Likewise, the controller can be located downhole or at the surface.

Figure 1:
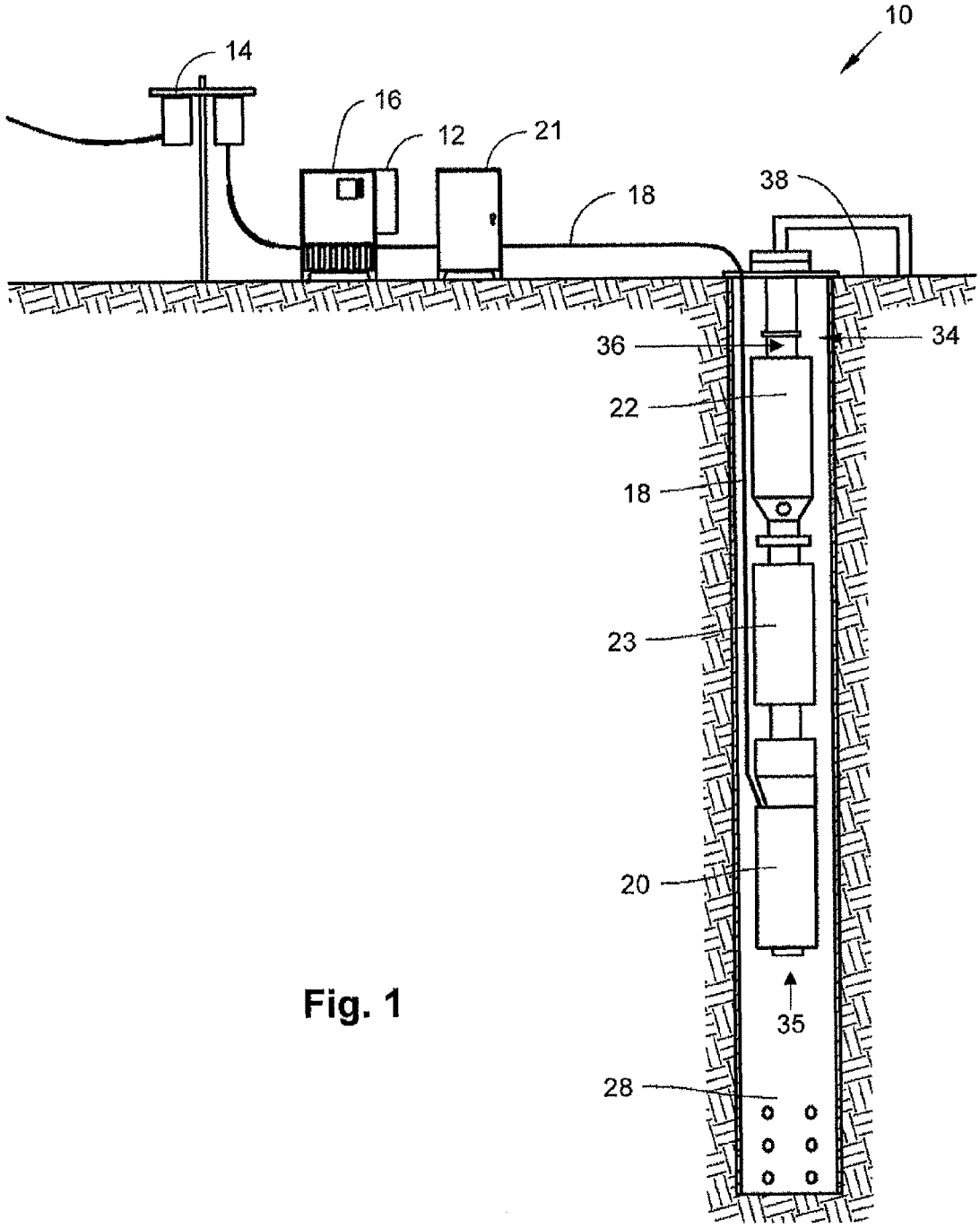
FIG. 1 is a side perspective view of an ESP assembly constructed in accordance with an embodiment of the present invention.

With reference now to FIG. 1, one type of electrical submersible pump (ESP) assembly in a well production system 10 includes a centrifugal pump 22, a motor 20, and a seal assembly 23 located between the pump 22 and motor 20, located with a well bore 28. The system 10 further includes a variable speed drive 16 and data monitoring and control device 12, e.g., a controller, typically located on the surface 38 and associated with the variable speed drive 16. The system 10 often includes a step-up transformer 21, located between the variable speed drive 16 and a power cable 18. The power cable 18 provides power and optionally communications between the variable speed drive 16 and the motor 20. The variable speed drive 16 may operate as a power source for providing electrical power for driving the motor 20. The cable 18 typically extends thousands of feet and thereby introduces significant electrical impedance between the variable speed drive 16 (or step-up transformer 21) and the motor 20. By altering the output voltage and frequency of the variable speed drive 16, the controller 12 associated with the variable speed drive 16 controls the voltage at motor 20 terminals. Typically, the cable 18 connects to a motor lead extension (not shown) proximate to the pumping system. The motor lead extension continues in the well bore 28 adjacent the pump assembly and terminates in what is commonly referred to as a "pothead connection" at the motor 20. In one embodiment, the motor terminal comprises the pothead connection.

Figure 2:
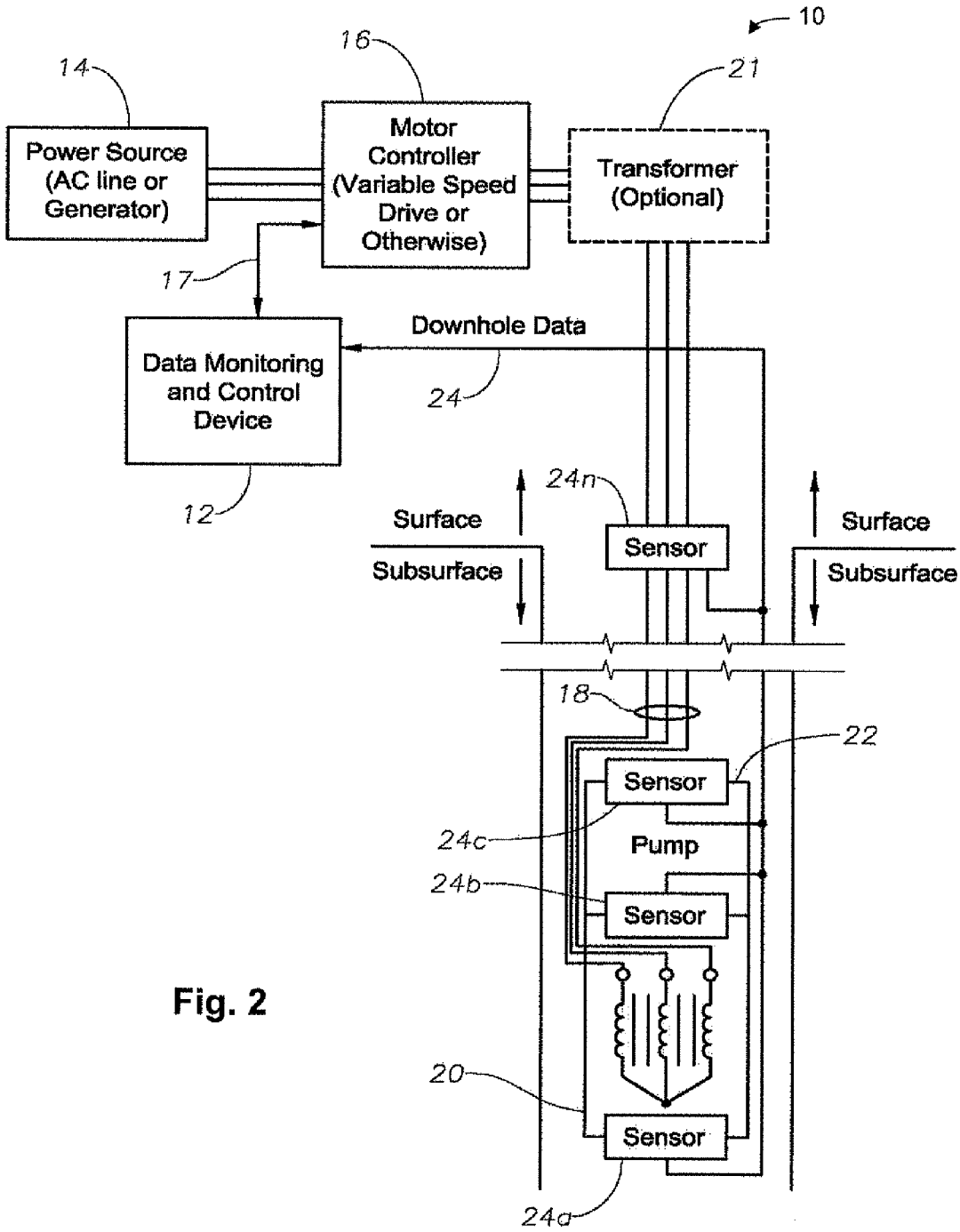
FIG. 2 is a schematic side view of an ESP assembly constructed in accordance with an embodiment of the present invention.

FIG. 2 illustrates an exemplary embodiment of a well production system 10, including a data monitoring and control device 12, e.g., a controller. The system 10 includes a power source 14 comprising an alternating current power source such as an electrical power line (electrically coupled to a power utility plant) or a generator electrically coupled to and providing three-phase power to a motor controller 16, which is typically a variable speed drive unit. Motor controller 16 can be any of the well known varieties, such as pulse width modulated variable frequency drives or other known controllers which are capable of varying the speed of production system 10. Both power source 14 and motor controller 16 are located at the surface level of the borehole and are electrically coupled to an induction motor 20 via a three-phase power cable 18. An optional transformer 21 can be electrically coupled between motor controller 16 and induction motor 20 in order to step the voltage up or down as required.

Further referring to the exemplary embodiments illustrated in FIGS. 1 and 2, the well production system 10 also includes downhole artificial lift equipment for aiding production, which comprises induction motor 20 and electrical submersible pump 22 ("ESP"), which may be of the type disclosed in U.S. Pat. No. 5,845,709. Motor 20 is electromechanically coupled to and drives pump 22, which induces the flow of gases and liquid up the borehole to the surface for further processing. Three-phase cable 18, motor 20, motor controller 16, and pump 22 form an ESP system.

Pump 22 can be, for example, a multi-stage centrifugal pump having a plurality of rotating impeller and diffuser stages which increase the pressure level of the well fluids for pumping the fluids to the surface location. The upper end of pump 22 is connected to the lower end of a discharge line 34 for transporting well fluids to a desired location. Typically, a seal section 23 is connected to the lower end of pump 22, and a motor 20 is connected to the lower end of the seal section for providing power to pump 22.

Well production system 10 also includes data monitoring and control device 12, typically a surface unit, which may communicate with downhole sensors 24*a*-24*n* via, for example, bi-directional link 24 or alternately via cable 18. In an exemplary embodiment, sensors 24*a*-24*n* monitor and measure various conditions within the borehole, such as pump discharge pressure, pump intake pressure, tubing surface pressure, vibration, ambient well bore fluid temperature, motor voltage and/or current, motor oil temperature and the like. Although not shown, data monitoring and control device 12 may also include a data acquisition, logging (recording) and control system which would allow device 12 to control the downhole system based upon the downhole measurements received from sensors 24*a*-24*n* via, for example, bi-directional link 24. Sensors 24*a*-24*n* can be located downhole within or proximate to induction motor 20, ESP 22 or any other location within the borehole. Any number of sensors may be utilized as desired.

Further referring to FIG. 2, data monitoring and control device 12 is linked to sensors 24*a*-24*n* via communication link 24 and motor controller 16 via link 17 in order to detect and break gas locks without requiring system shutdown. In an example embodiment, the gas lock detecting and breaking functionality of device 12 is conducted based solely upon surface data, such as current, voltage output and/or torque, received from motor controller 16 via bi-directional link 17. In other embodiments, the functionality may also be affected based upon data received from one or more of downhole sensors 24*a*-24*n*.

Data monitoring and control device 12 communicates over well production system 10, using the communication links described herein, on at least a periodic basis utilizing techniques, such as, for example, those disclosed in U.S. Pat. No. 6,587,037, entitled METHOD FOR MULTI-PHASE DATA COMMUNICATIONS AND CONTROL OVER AN ESP POWER CABLE and U.S. Pat. No. 6,798,338, entitled RF COMMUNICATION WITH DOWNHOLE EQUIPMENT. Device 12 is coupled to motor controller 16 via bi-directional link 17 in order to receive measurements such as, for example, amperage, current, voltage and/or frequency regarding the three phase power being transmitted downhole. Such control signals would regulate the operation of the motor and/or pump 22 to optimize production of the well production assembly 10, such as, for example, detecting and breaking gas locks. Moreover, these control signals may be transmitted to some other desired destination for further analysis and/or processing.

Data monitoring and control device 12 controls motor controller 16 by controlling such parameters as on/off, frequency (F), and/or voltages, each at one of a plurality of specific frequencies, which effectively varies the operating speed of motor 20. Such control is conducted via link 17. The functions of device 12 may execute within the same hardware as the other components comprising device 12, or each component may operate in a separate hardware element. For example, the data processing, data acquisition/logging and data control functions of the present invention can be achieved via separate components or all combined within the same component.

During production, some wells produce gas along with oil. As such, there is a tendency for the gas to enter the pump assembly 22 along with the well fluid, which can decrease the volume of oil produced or may even lead to a "gas lock." A gas lock is a condition in an ESP assembly in which gas interferes with the proper operation of impellers and other pump components, preventing the pumping of liquid.

Figure 3:
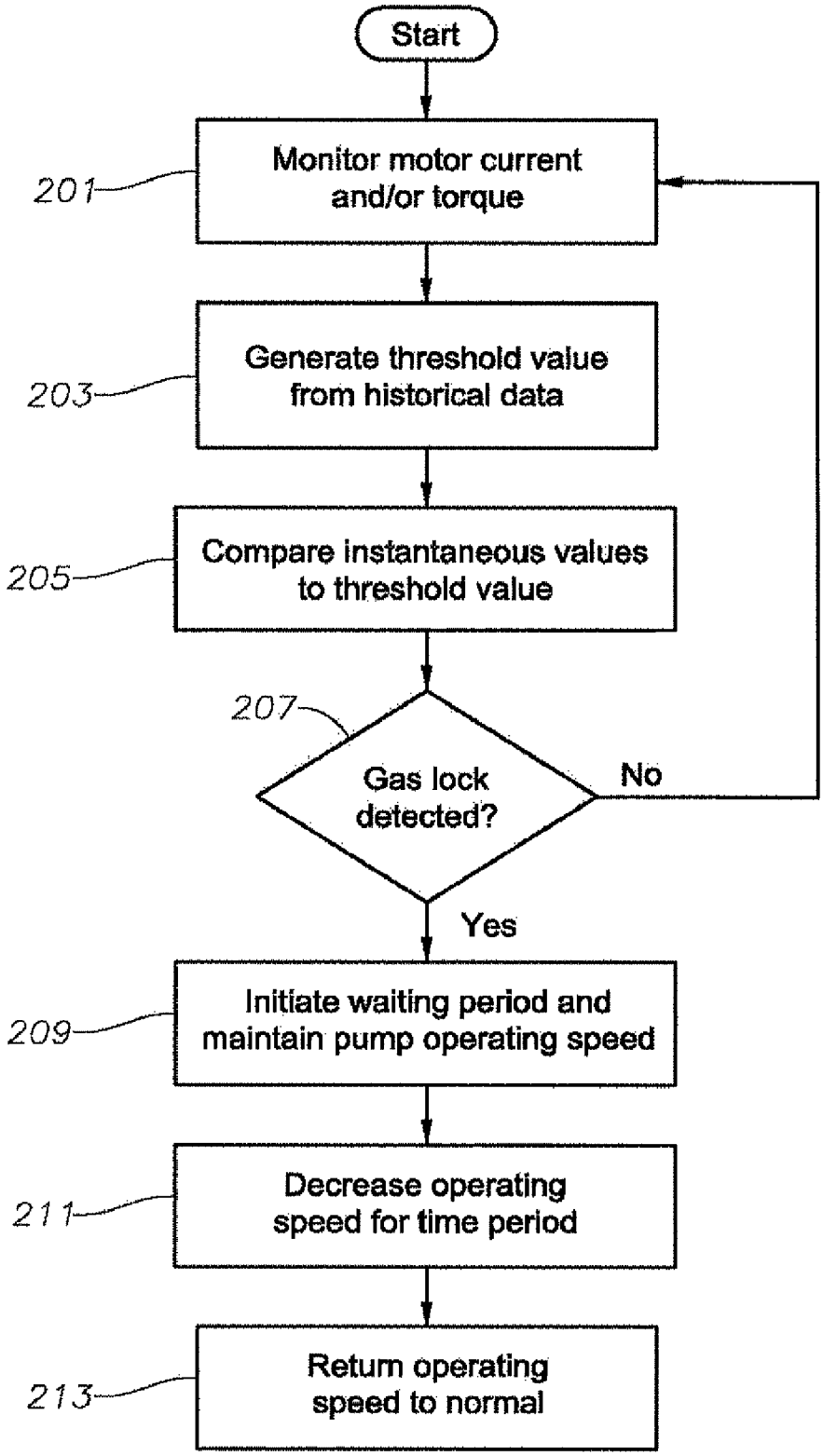
FIG. 3 is a flow diagram of a method of detecting and breaking gas lock according to an embodiment of the present invention.

Referring to FIG. 3, an exemplary algorithm for detecting and breaking a gas lock will now be described. Data monitoring and control device 12 also comprises a processor and memory which performs the logic, computational, and decision-making functions of the present invention and can take any form as understood by those in the art. See, e.g., FIGS. 5 and 6. The memory can include volatile and nonvolatile memory known to those skilled in the art including, for example, RAM, ROM, and magnetic or optical disks, just to name a few.

At step 201, data monitoring and control device 12, e.g., the controller, continuously monitors the output current, voltage and/or torque of motor controller 16 via bi-directional link 17 in order to detect and break gas locks in accordance with the present invention. However, in the alternative, output measurements from downhole sensors 24*a*-24*n* may also be monitored. At step 203, data monitoring and control device 12 will generate a threshold value of the motor current and/or torque from historical data. The threshold value can be based on a historical value, such as a long-term average of the motor current or motor torque using a time constant long enough to filter out any short term variations in such measurements. Alternately, the threshold value can be based on another historical value, such as a peak value for given data window. When a gas lock does occur, the motor current or motor torque will typically decrease by 30-50%. To determine a 30% drop in the motor torque and/or current, the threshold value can be generated to be, for example, 70% of a long-term average value. Alternately, the threshold value can be generated to be 65% to 75% of a peak value for a given historical data window, i.e., a predetermined period of between 2 and 5 minutes, preferably the last 3 minutes. Thereafter, at step 205, the instantaneous value is continuously compared to the threshold value. In another preferred embodiment, the motor torque is measured instead of the motor current because the torque is more sensitive to downhole phenomena. If control device 12 does not detect an occurrence of gas lock based on the comparison in step 207, the algorithm loops back to step 201 and begins the process again.

Should data monitoring and control device 12 detect an occurrence of gas lock, control device 12 will proceed to step 209. At this step, control device 12 will instruct motor controller 16 via link 17 to maintain the same operating speed for a predetermined waiting period. In the most preferred embodiment, this waiting period has a length of 6 to 7 minutes, however, other waiting periods, including a waiting period of 3 to 15 minutes, can be programmed based upon design constraints. In an alternative embodiment, the waiting period will be limited, at least in part, by a predetermined maximum pump temperature, which would be communicated to device 12 from downhole sensors 24*a*-24*n* via communication link 24.

Further referring to the exemplary algorithm of FIG. 3, as motor 20 maintains this operating speed at step 209, it produces a somewhat static condition as pump 22 produces just enough head to support the column of fluid in the tubing above, but not enough to pump the fluid upwards to the surface. As a result, the gas bubbles in the fluid directly over the pump begin to rise, while the fluid settles and becomes denser.

At step 211, data monitoring and control device 12 ends the waiting period and decreases the operating frequency to a lower value, such as, for example, 20-25 Hz. The normal operating frequency is typically set at 60 Hz, This decreased operating frequency is maintained for a predetermined period of time, such as, for example, 10-15 seconds. During this time, pump 22 can no longer support the fluid column just above it and, thus, the fluid begins to fall back through pump 22, flushing out the trapped gas. At the end of this low speed period of step 211, device 12 increases the operating frequency of pump 22 back to normal and production begins again at step 213.

Embodiments of the present invention further provide an algorithm for optimizing an operating speed of the electrical submersible pump assembly to maximize production without need for operator intervention. The algorithm increases the pump operating speed by a predetermined increment, e.g., between 0.08 and 0.4 Hz, preferably 0.1 Hz, up to a preset maximum pump operating speed, e.g., 62 Hz, when the instantaneous value is continually above the threshold value for a predetermined stabilization period, e.g., between 10 to 20 minutes, preferably 15 minutes. The algorithm decreases the pump operating speed by a predetermined increment, e.g., between 0.08 and 0.4 Hz, preferably 0.1 Hz, if the instantaneous value is continually below the threshold value for a predetermined initialization period, e.g., between 90 seconds and 3 minutes, preferably 2 minutes. In the absence of gas lock or gas bubbles for a reasonable period of time, the algorithm increases the pump operating speed in a step-wise fashion to maximize production. In the presence of gas bubbles but not true gas lock, the algorithm does not alter the pump operating speed. Gas bubbles, without causing an occurrence of gas lock, can cause a temporary drop in the motor current or motor torque as understood by those skilled in the art. If the algorithm detects an occurrence of gas lock, in which the instantaneous value is continually below the threshold value for a period of time, e.g., 2 minutes, the algorithm lowers the pump operating speed (and the rate of production) by a small increment to better adjust to the level of gas and attempt to prevent further occurrences of gas lock as understood by those skilled in the art.

Figure 4:
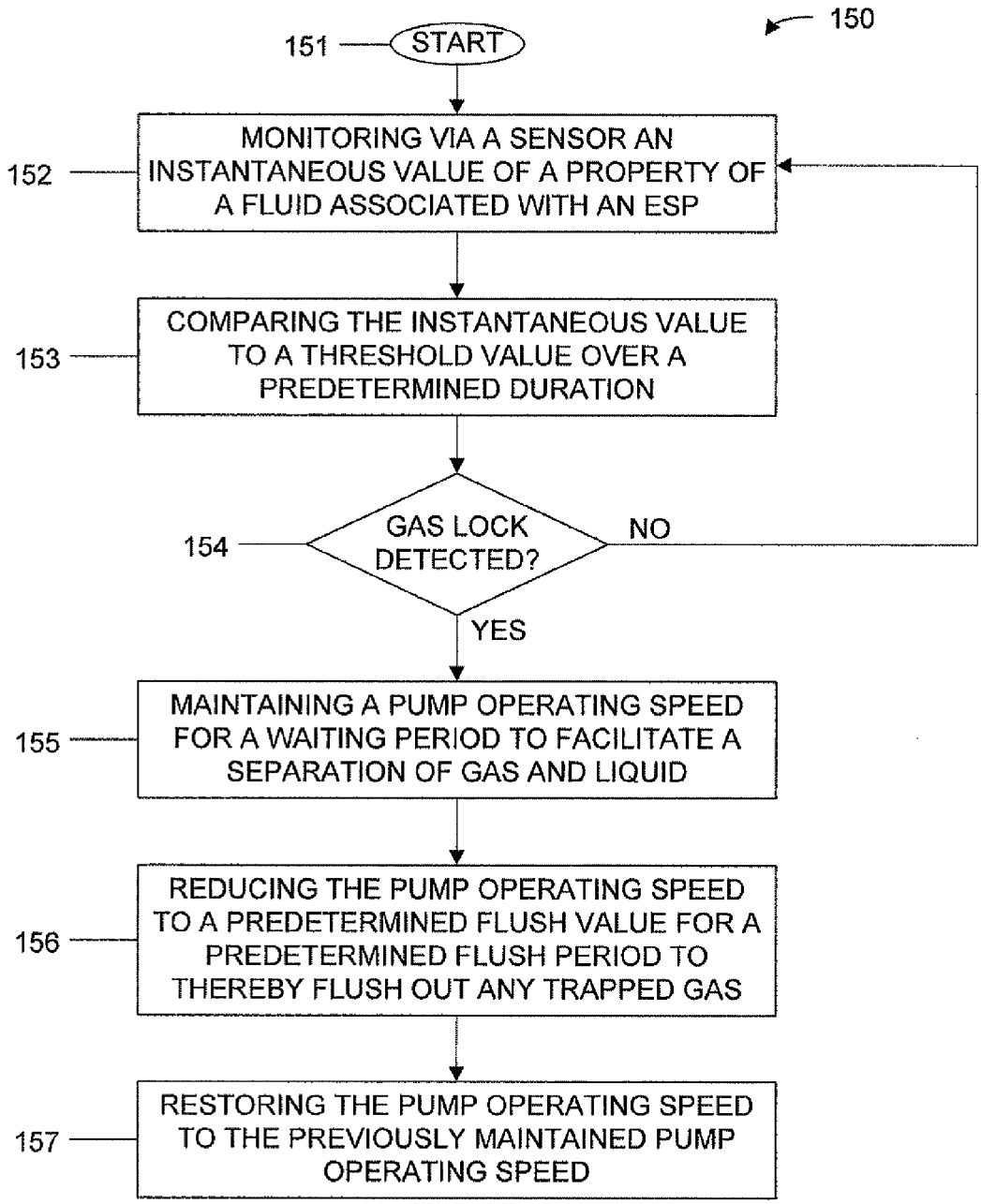
FIG. 4 is a flow diagram of a method of detecting and breaking gas lock according to an embodiment of the present invention.

As illustrated in FIG. 4, embodiments of the present invention can include a method 150 of detecting a gas lock in an electrical submersible pump assembly. The method 150 can include monitoring via a sensor 24*a*-24*n* an instantaneous value of a property of a fluid associated with an electrical submersible pump assembly (step 152). The assembly can include a multi-stage electrical submersible pump 22 having an inlet 35 and a discharge 36, a pump motor 20 to drive the pump 22, a discharge line 34 for transporting pumped fluid from the pump discharge to the surface 38, and a controller 12 configured to receive data from the sensor 24*a*-24*n* and to detect an occurrence of gas lock in the electrical submersible pump assembly. The method 150 can also include comparing the instantaneous value to a threshold value over a predetermined duration by the controller 12 to thereby detect the occurrence of gas lock in the electrical submersible pump assembly (step 153). If gas lock is detected by the controller (step 154), the method can further include breaking the detected occurrence of gas lock by: maintaining a pump operating speed for a first predetermined duration defining a waiting period to facilitate a separation of gas and liquid located above the pump (step 155), reducing the pump operating speed to a predetermined value defining a flush value for a second predetermined duration defining a flush period so that the fluid located above the pump falls back through the pump flushing out any trapped gas (step 156), and restoring the pump operating speed to the previously maintained pump operating speed (step 157). In a preferred embodiment, the waiting period is between 6 to 7 minutes, the flush period is between 10 and 15 seconds, and the pump operating speed is reduced during the flush period to between 20 and 25 Hz.

In an example embodiment, the sensor 24*a*-24*n* can be a differential pressure gauge for measuring a differential pressure of the fluid in the pump between the pump inlet 35 and pump discharge 36, e.g., the bottom and top of the pump, to determine a drop in pressure. For example, a decrease of about 50% of a normal pressure, e.g., an average pressure, for a period of about 30 seconds can indicate gas lock.

In another example embodiment, the sensor 24*a*-24*n* can be a pressure gage located in a pump stage located toward the inlet 35, e.g., the bottom stages of the pump, to determine a drop in pressure. For example, a decrease of about 30% of a historical pressure, e.g., a peak pressure of the past three (3) minutes, for a period of about 30 seconds can indicate gas lock.

In yet another example embodiment, the sensor 24*a*-24*n* can be a fluid temperature sensor located toward the discharge 36, e.g., the top of the pump, to determine an increase in temperature. For example, an increase of about 20% of a historical temperature, e.g., a rolling average of the values over the past five (5) minutes, for a period of about 30 seconds can indicate gas lock.

In another example embodiment, the sensor 24*a*-24*n* can be a free gas detector located within the pump to determine a high level of free gas of a function of volume. For example, a level of free gas above about 50% by volume for a period of about 30 seconds can indicate gas lock.

In another example embodiment, the sensor 24*a*-24*n* can be an electrical resistivity gage located within the pump to determine a high level of resistivity. For example, a high level of resistivity of about 200 Ohms per cm or more for a period of about 30 seconds can indicate gas lock.

In another example embodiment, the sensor 24*a*-24*n* can be a flow meter located within surface production tubing to determine no or little flow. For example, a flow of about zero for a period of about 30 seconds can indicate gas lock.

In another example embodiment, the sensor 24*a*-24*n* can be a vibration sensor attached to a tubing string to measure an acceleration of the fluid within the tubing string to determine a vibration signature, or characteristic pattern of vibration, responsive to the measured acceleration of the fluid. The vibration signature can refer to the actual signal from a vibration sensor and also the spectrum, or frequency-based representation. The determined vibration signature can then be compared to one or more predetermined vibration signatures stored in memory and associated with gas lock to thereby indicate gas lock. The predetermined vibration signatures can be determined by testing as understood by those skilled in the art. As understood by those skilled in the art, a vibration sensor can include an XY vibration sensor, which is a sensor that measures vibration or acceleration in two dimensions, or along two axes. As described in jointly-owned pending U.S. patent application Ser. No. 12/360,677, titled "Electrical Submersible Pump Rotation Sensing Using an XY Vibration Sensor," filed on Jan. 27, 2009, which is incorporated herein in its entirety, the measurements for the two dimensions can be correlated through a Fourier analysis, or other frequency analysis as understood by those skilled in the art, to determine a frequency and direction of rotation of an ESP.

Example embodiments can include different durations for determining gas lock. As understood by those skilled in the art, too short of a duration can result in false positives; similarly, too long of a duration can result in delayed detection, perhaps resulting in damage to the motor. Example embodiments can include a predetermined duration for the comparison a period between about 15 seconds and about 1 minute.

Embodiments of the present invention have significant advantages. Example embodiments have the ability to reliably detect a gas lock, without operator intervention, based upon surface data and/or downhole data. Also, example embodiments have the ability to break a gas lock once detected, without requiring system to be shut down.

Embodiments of a data monitoring and control device 12, e.g., a controller, may take various forms. In one embodiment, the control device 12 may be part of the hardware located at the well site, included in the software of a programmable ESP controller, variable speed drive, or may be a separate box with its own CPU and memory coupled to such components. Also, control device 12 may even be located across a network and include software code running in a server which bi-directionally communicates with production system 10 to receive surface and/or downhole readings and transmit control signals accordingly.

Figure 5:
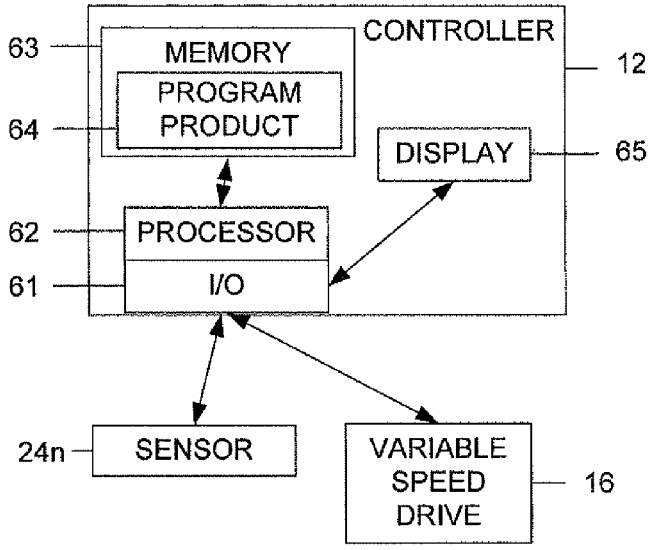
FIG. 5 is a schematic diagram of controller for detecting and breaking gas lock according to an embodiment of the present invention.

As illustrated in FIG. 5, example embodiments include a controller 12, having, for example, input-output I/O devices, e.g., an input/output interface 61; one or more processors 62; memory 63, such as, tangible computer readable media; and optionally a display 65. The memory 63 of the controller can include program product 64 as described herein.

Figure 6:
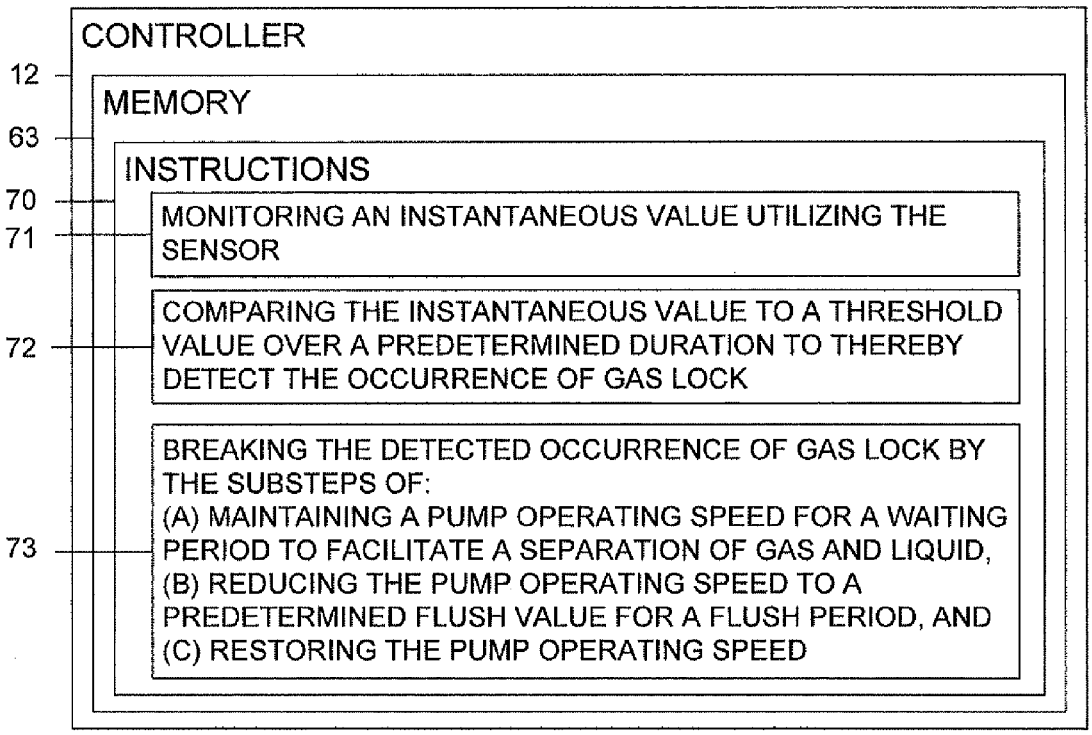
FIG. 6 is a schematic diagram of a controller having computer program product stored in memory thereof according to an embodiment of the present invention.

As illustrated in FIGS. 5 and 6, embodiments of the present invention include a memory 63 having stored therein a program product, stored on a tangible computer memory media, operable on the processor 62, the program product comprising a set of instructions 70 that, when executed by the processor 62, cause the processor 62 to detect an occurrence of gas lock by performing various operations. The operations include: monitoring an instantaneous value utilizing the sensor 71 and comparing the instantaneous value to a threshold value over a predetermined duration to thereby detect the occurrence of gas lock in the electrical submersible pump assembly 72. The operations further include breaking the detected occurrence of gas lock by the substeps of: (a) maintaining a pump operating speed for a first predetermined period defining a waiting period to facilitate a separation of gas and liquid located above the pump, (b) reducing the pump operating speed to a predetermined value defining a flush value for a second predetermined period defining a flush period so that the fluid located above the pump falls back through the pump flushing out any trapped gas, and (c) restoring the pump operating speed to the previously maintained pump operating speed 73.

Example embodiments also include computer program product stored on a tangible computer readable medium that is readable by a computer, the computer program product comprising a set of instructions that, when executed by a computer, causes the computer to perform the various operations. The operations can include detecting an occurrence of gas lock in a electrical submersible pump assembly, including (i) monitoring an instantaneous value associated with the pump motor of the electrical submersible pump assembly, (ii) generating a threshold value based on historical data of values associated with the pump motor of the electrical submersible pump assembly, and (iii) comparing the instantaneous value to the threshold value to thereby detect the occurrence of gas lock in the electrical submersible pump assembly. The operations can further include breaking the detected occurrence of gas lock, including (i) maintaining a pump operating speed for a first predetermined duration defining a waiting period to facilitate a separation of gas and liquid located above the pump, (ii) reducing the pump operating speed to a predetermined value defining a flush value for a second predetermined duration defining a flush period so that the fluid located above the pump falls back through the pump flushing out any trapped gas, and (iii) restoring the pump operating speed to the previously maintained pump operating speed.

It is important to note that while embodiments of the present invention have been described in the context of a fully functional system and method embodying the invention, those skilled in the art will appreciate that the mechanism of the present invention and/or aspects thereof are capable of being distributed in the form of a computer readable medium of instructions in a variety of forms for execution on a processor, processors, or the like, and that the present invention applies equally regardless of the particular type of signal bearing media used to actually carry out the distribution. Examples of computer readable media include but are not limited to: nonvolatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, flash drives, and other newer types of memories, and transmission type media such as digital and analog communication links. For example, such media can include both operating instructions and/or instructions related to the system and the method steps described above.

Moreover, it is to be understood that the invention is not limited to the exact details of construction, operation, exact materials, or embodiments shown and described, as modifications and equivalents will be apparent to one skilled in the art. For example, although the present invention has focused on measurements of motor torque and/or current, other measurements could also be used to indicate a gas locked state. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

That claimed is:

1. A computer-implemented method of detecting an occurrence of gas lock in a multi-stage electrical submersible pump assembly for pumping fluid in a well bore, the well bore extending downward from a surface, the assembly including a multi-stage electrical submersible pump having an inlet and a discharge, a pump motor to drive the pump, and a discharge line for transporting pumped fluid from the pump discharge to the surface, the method comprising:

monitoring via a sensor an instantaneous value of a property of a fluid associated with an electrical submersible pump assembly; and comparing the instantaneous value to a threshold value over a predetermined duration by a controller configured to receive data from the sensor and to detect the occurrence of gas lock in the electrical submersible pump assembly, wherein the sensor includes one or more of the following: a differential pressure gauge for measuring a differential pressure of the fluid between the pump inlet and pump discharge, a pressure gage located in a pump stage located toward the inlet to measure a pressure, a fluid temperature sensor located toward the discharge, a free gas detector located in a pump stage near the pump discharge, an electrical resistivity gage located within the pump, a flow meter located within surface production tubing, and a vibration sensor attached to a tubing string to measure an acceleration of the fluid within the tubing string to determine a vibration signature responsive to the measured acceleration of the fluid.

2. A computer-implemented method of claim 1, wherein the sensor comprises a differential pressure gauge, wherein the step of monitoring via a sensor comprises measuring a differential pressure of the fluid in the pump between the pump inlet and pump discharge, and wherein the step of comparing the instantaneous value to a threshold value comprises generating the threshold value by the controller responsive to historical data of values associated with the sensor.

3. A computer-implemented method of claim 2, wherein the step of comparing the instantaneous value to a threshold value comprises generating the threshold value based on a decrease of about 50% of an average of the instantaneous values from a predetermined range of the historical data, and wherein the predetermined duration is a period of about 30 seconds.

4. A computer-implemented method of claim 1, wherein the sensor comprises a pressure gage, and wherein the step of monitoring comprises measuring a pressure of the fluid located in a pump stage located toward the inlet, and wherein the step of comparing the instantaneous value to a threshold value comprises generating the threshold value with controller responsive to historical data of values associated with the sensor.

5. A computer-implemented method of claim 4, wherein the step of comparing the instantaneous value to a threshold value comprises generating the threshold value based on a decrease of about 30% of a peak of the values over a period of about 3 minutes, and wherein the predetermined duration is a period of about 30 seconds.

6. A computer-implemented method of claim 1, wherein the sensor comprises a fluid temperature sensor, wherein the step of monitoring comprises measuring a temperature of the fluid located in a pump stage located toward the discharge, and wherein the step of comparing the instantaneous value to a threshold value comprises generating the threshold value with controller responsive to historical data of values associated with the sensor.

7. A computer-implemented method of claim 6, wherein the step of comparing the instantaneous value to a threshold value comprises generating the threshold value based on an increase of about 20% of an average of the values over a period of about 5 minutes, and wherein the predetermined duration is a period of about 30 seconds.

8. A computer-implemented method of claim 1, wherein the sensor includes a free gas detector located within the pump.

9. A computer-implemented method of claim 8, wherein the threshold value is a level of free gas of about 50% by volume, and wherein the predetermined duration is a period of about 30 seconds.

10. A computer-implemented method of claim 1, wherein the sensor includes an electrical resistivity gage located within the pump.

11. A computer-implemented method of claim 1, wherein the sensor includes a flow meter located within surface production tubing.

12. A computer-implemented method of claim 11, wherein the threshold value is a flow of about zero, and wherein the predetermined duration is a period of about 30 seconds.

13. A computer-implemented method of claim 1, wherein the sensor includes a vibration sensor attached to a tubing string to measure an acceleration of the fluid within the tubing string; wherein comparing the instantaneous value to a threshold value over a predetermined duration comprises determining a vibration signature responsive to the measured acceleration of the fluid; and wherein the threshold value is one or more predetermined vibration signatures stored in memory and associated with gas lock.

14. A computer-implemented method of claim 1, further comprising: breaking the detected occurrence of gas lock by the substeps of:

(a) maintaining a pump operating speed for a first predetermined period defining a waiting period to facilitate a separation of gas and liquid located above the pump;

(b) reducing the pump operating speed to a predetermined value defining a flush value for a second predetermined period defining a flush period so that the fluid located above the pump falls back through the pump flushing out any trapped gas; and (c) restoring the pump operating speed to the previously maintained pump operating speed.

15. A submersible pump assembly, comprising:

a multi-stage electrical submersible pump located in a well bore for pumping a fluid, the pump having an inlet and a discharge;

a pump motor located in the well bore, to drive the electrical submersible pump;

a discharge line for transporting pumped fluid from the pump discharge to the surface;

a sensor to measure a property of a fluid associated with the pump, wherein the sensor includes one or more of the following: a differential pressure gauge for measuring a differential pressure of the fluid between the pump inlet and pump discharge, a pressure gage located in a pump stage located toward the inlet to measure a pressure, a fluid temperature sensor located toward the discharge, a free gas detector located in a pump stage near the pump discharge, an electrical resistivity gage located within the pump, a flow meter located within surface production tubing, and a vibration sensor attached to a tubing string to measure an acceleration of the fluid within the tubing string to determine a vibration signature responsive to the measured acceleration of the fluid;

a controller configured to receive data from the sensor and to detect an occurrence of gas lock in the multi-stage electrical submersible pump, the controller comprising:

a processor positioned to detect an occurrence of gas lock, an input/output interface to communicate with the sensor, and a memory having stored therein a program product, stored on a tangible computer memory media, operable on the processor, the program product comprising a set of instructions that, when executed by the processor, cause the processor to detect an occurrence of gas lock by performing the operations of:

monitoring an instantaneous value utilizing the sensor; and comparing the instantaneous value to a threshold value over a predetermined duration to thereby detect the occurrence of gas lock in the electrical submersible pump assembly.

16. A submersible pump assembly of claim 15, wherein the threshold value is generated by the controller responsive to historical data of values associated with the sensor.

17. A submersible pump assembly of claim 15, wherein the operations further include: breaking the detected occurrence of gas lock by the substeps of:

(a) maintaining a pump operating speed for a first predetermined period defining a waiting period to facilitate a separation of gas and liquid located above the pump, (b) reducing the pump operating speed to a predetermined value defining a flush value for a second predetermined period defining a flush period so that the fluid located above the pump falls back through the pump flushing out any trapped gas, and (c) restoring the pump operating speed to the previously maintained pump operating speed.

18. A submersible pump assembly of claim 15, wherein the predetermined duration is a period between about 15 seconds and about 1 minute.

* * * * *